US005133301A

United States Patent [19]

Hsu

[11] Patent Number: 5,133,301

[45] Date of Patent: Jul. 28, 1992

[54] FUEL INJECTORS FOR DIESEL ENGINES

[75] Inventor: Bertrand D. Hsu, Erie, Pa.

[73] Assignee: General Electric Company, Erie, Pa.

[21] Appl. No.: 636,853

[22] Filed: Jan. 2, 1991

[51] Int. Cl.[5] ..... F02D 19/04

[52] U.S. Cl. ..... 123/23

[58] Field of Search ..... 123/23, 25 A, 25 E, 123/25 G, 294

[56] References Cited

U.S. PATENT DOCUMENTS

| | | | |
|---|---|---|---|
| 4,782,794 | 11/1988 | Hsu et al. | 123/23 |
| 4,825,842 | 5/1989 | Steiger | 123/23 |
| 4,856,713 | 8/1989 | Burnett | 123/23 |
| 4,862,837 | 9/1989 | Holmes | 123/23 |

*Primary Examiner*—Noah P. Kamen

[57] ABSTRACT

Replenishment water is supplied to a coal-water slurry fuel injector between fuel releases, to resist clogging in the injector. The injector includes a cylindrical body having a needle valve in a central bore, and a fuel intake port which releases fuel into the engine through an opening in the side of the injector body. A nozzle having high pressure ducts is provided in an end of the body for releasing fuel into the engine. A clearance space is provided between the needle valve and the central bore for passage of the replenishment water into the injector. The replenishment water is forced into the nozzle and the high pressure ducts between releases of fuel. Lubricants can be added to the replenishment water, if desired. The replenishment water resists injector clogging by maintaining the fluidity of the coal-water slurry and purging dried coal particles.

18 Claims, 1 Drawing Sheet

FUEL INJECTORS FOR DIESEL ENGINES

This invention relates to fuel injectors for diesel engines, and more particularly, to coal slurry fuel injectors which are resistant to clogging.

BACKGROUND OF THE INVENTION

Diesel engines can be operated on a combination of diesel fuel and a coal-water slurry, using fuel injectors which inject both the diesel fuel and the slurry into the engine. For example, U.S. Pat. No. 4,736,712 describes a self purging dual fuel injector which first injects a pilot charge of diesel fuel into the engine, followed by coal slurry.

When an injector is used to release coal-water slurry fuel into a diesel engine, the slurry in the high pressure cavities of the injector can lose its fluidity due to a loss of water through the needle valve guide clearance, and the injector can easily become clogged with dried coal particles. Thus, there is a need for coal-water slurry fuel injectors which resist clogging.

Accordingly, one object of this invention it to provide new and improved fuel injectors for diesel engines.

Another object is to provide new and improved coal slurry fuel injectors which resist clogging.

SUMMARY OF THE INVENTION

In keeping with one aspect of this invention, a fuel injector includes a cylindrical body having a bore, and an injector tip secured to the body. The tip has a central bore which is contiguous with the bore in the body, and a closed end opposite the body. A nozzle is provided in the closed end, with high pressure ducts for releasing fuel into the engine.

The injector includes at least one fuel intake port in fluid communication with the central bore. A needle valve between the central bore and the inlet of the nozzle controls the flow of fuel into the nozzle, and a spring maintains the needle valve in the proper position.

A clearance space is provided between the needle valve and the central bore, and replenishment water is forced into the injector tip between the needle valve and the bore. The replenishment water is forced into the nozzle and through the high pressure ducts between releases of fuel. Lubricants can be added to the replenishment water, if desired. The replenishment water resists injector clogging by maintaining the fluidity of the coal-water slurry in the high pressure cavity and purges dried coal particles that entered the injector during the high pressure injection period but did not pass through the ducts.

BRIEF DESCRIPTION OF THE DRAWINGS

The above-mentioned and other features of an embodiment of this invention and the manner of obtaining them will become more apparent, and will be best understood by reference to the following description, taken in conjunction with the accompanying drawings in which.

DETAILED DESCRIPTION

Figure 1:
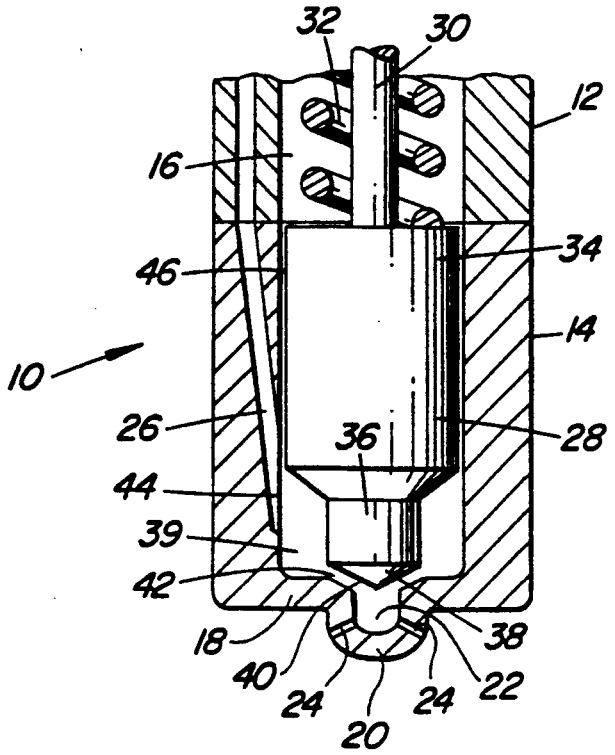
FIG. 1 is a cutaway view of a fuel injector made in accordance with the principles of this invention.

As seen in FIG. 1, a fuel injector 10 includes a cylindrical body 12 and an injector tip 14. The injector tip 14 is secured to the injector body 12 in any suitable way, such as welding, threaded engagement or the like.

The injector body 12 and the tip 14 have a central bore 16 which extends contiguously through the body 12 and the tip 14 to a closed end 18 of the tip 14. The closed end 18 includes a nozzle 20 which extends outwardly away from the end 18, creating a pocket 22 inside the nozzle 20. The nozzle 20 includes at least one, and preferably several, high pressure ducts 24. Fuel is released into an engine (not shown) through the high pressure ducts 24.

The injector 10 has at least one fuel intake port 26 which is in fluid communication with the bore 16. A needle valve 28 is adjustably secured in the bore 16 to control the flow of fuel as it passes from the intake port 26 to the nozzle 20. The needle valve 28 includes a shaft 30 for making external adjustments, and a spring 32 for maintaining the valve 28 in a desired position.

The needle valve 28 includes a first cylindrical portion 34, a reduced cylindrical portion 36, and an end 38. The diameter of the first cylindrical portion 34 is slightly less than the diameter of the bore 16, as will be seen, and the diameter of the reduced portion 36 is substantially less than the diameter of the bore 16, creating an area 39 through which the fuel slurry passes. The end 38 has a beveled edge 40 which creates a substantially uniform space 42 between the edge 40 and the end 18.

Fuel entering the bore 16 through the intake port 26 enters the area 39 at an opening 44. The opening 44 is between the first cylindrical portion 34 and the space 42. The cylindrical portions 34, 36 of the needle valve 28 are proportioned so that the first cylindrical portion 34 does not cover the opening 44, regardless of how the needle valve 28 is adjusted.

A clearance 46 is provided between the first portion 34 and the wall of the bore 16. The clearance 46 can be any suitable distance which allows pressurized water to flow around the needle valve 28 to the cavity 39. In some applications, the clearance 46 could be between about 4 and 15 micrometers, and in one application, was about 10 micrometers.

In use, a coal-water slurry enters the injector 10 through the intake portion 26 at a relatively high pressure of about 9,000 to 10,000 p.s.i. during the injection period. Generally, the high injector pressure lasts about five percent of the cycle time, or through about 36°0 of crankshaft rotation. At the same time, replenishment water is constantly supplied through the central bore 16, but at a substantially reduced pressure, such as about 1,500 to 2,000 p.s.i. Although this pressure is significantly less than the fuel injection pressure during the about five percent injection time period, the replenishment water is effectively provided about 95 percent of the cycle time. The replenishment water dilutes residual fuel in the injector, purges dried coal particles and the clearance 46 and dilutes the residual slurry in the area 39, and generally resists clogging in the injector.

Figure 2:
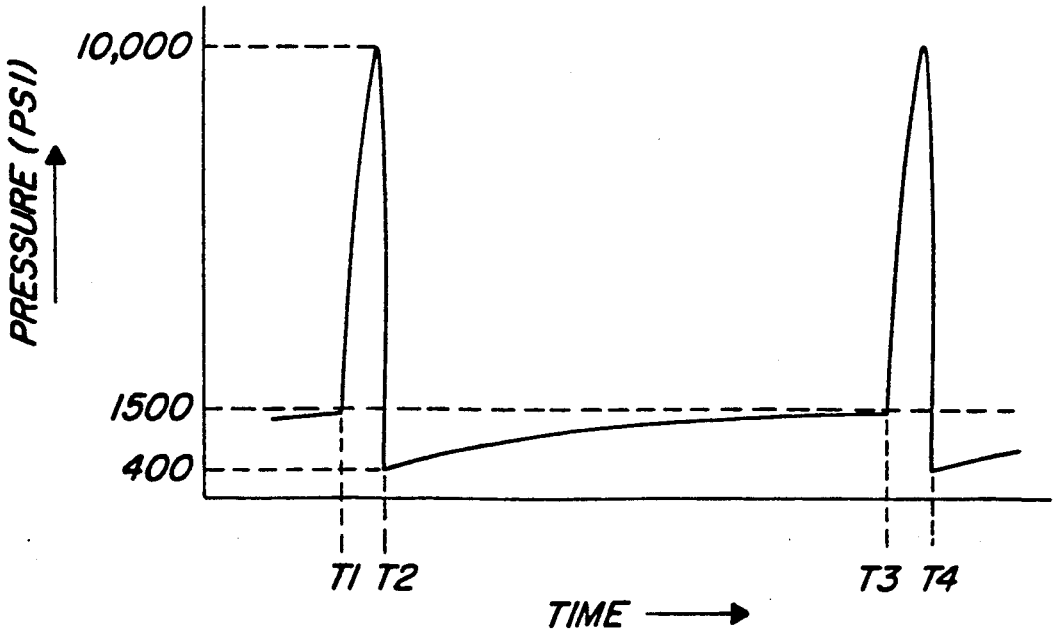
FIG. 2 is a diagram showing relative pressures in the injector of FIG. 1 during operation.

The operation of the injector can be better understood with reference to FIG. 2, which shows the pressure in the injector with respect to time. Fuel is first released into the engine between times T1 and T2, at a pressure of perhaps 10,000 p.s.i., and again between times T3 and T4. In this context, the time between T1 and T3 represents one engine cycle. Between times T2 and T3, replenishment water is forced into the injector under a lower pressure which approaches perhaps 1,500 to 2,000 p.s.i. The pressure is reduced to about 400 p.s.i.

system residual pressure at times T2 and T4 due to the sudden release of high injection pressure by, for example, the opening of a spill port.

While this invention can be used in many applications, it has been found to be effective using coal slurry concentrations of about 50% coal, with replenishment water containing about 30% UCON 50HB5100, a water soluble lubricant.

The many advantages of this invention are now apparent. The replenishment water resists injector clogging, resulting in improved engine performance and more efficient operation.

While the principles of the invention have been described above in connection with specific apparatus and application, it is to be understood that this description is made only by way of example and not as a limitation on the scope of the invention.

I claim:

1. A system for delivering a coal-water slurry fuel into an internal combustion engine comprising:

means for delivering the fuel into the engine at predetermined time intervals during the engine's operating cycle;

a coal-water slurry source operatively connected to the fuel delivery means; and means for adding replenishment water, operatively connected to the fuel delivery means and a source of replenishment water, to residual fuel in the system between operating cycles, the replenishment water comprising about 70% water and about 30% water soluble lubricant, such that the replenishment water dilutes the residual fuel, purges dried coal particles and reduces clogging.

2. The system of claim 1 wherein the delivery means comprises:

a fuel injector having a top with a central bore;

a nozzle operatively positioned at one end of the tip, the tip having a pocket, an area and at least one high pressure duct for releasing the fuel into the engine;

a fuel intake port for delivering the fuel into the bore; and an adjustable needle valve operatively positioned in the bore, such that a space is defined between the bore and the needle valve for permitting the passage of the replenishment water into the area and the fuel intake port.

3. The system of claim 2 wherein the needle valve comprises:

a first cylindrical portion having a first diameter, and a second cylindrical portion having a second diameter which is smaller than the first diameter, the space being defined between the first cylindrical portion and the bore.

4. The system of claim 3 wherein the fuel intake port release the fuel into the bore adjacent the second portion of the needle valve.

5. The system of claim 3 wherein the needle valve further comprises:

an end portion having a bevelled edge which, during the release of fuel into the engine, defines a passage between the bore and the pocket.

6. The system of claim 2 further comprising:

spring means for maintaining the needle valve in a predetermined position.

7. The system of claim 1 wherein the fuel is composed of about 45% to about 50% coal and about 50% to about 55% water.

8. The system of claim 1 wherein the water soluble lubricant is U CON 50HB5100.

9. A method of delivering a coal-water slurry fuel to an internal combustion engine comprising the steps of:

delivering the fuel under relatively high pressure thru a fuel injector into the engine at predetermined time intervals during the engine's operating cycle; and adding replenishment water comprising about 70% water and about 30% water soluble lubricant to the residual slurry fuel in the injector between the operating cycles, such that the replenishment water dilutes the residual fuel thereby reducing injector clogging.

10. The method of claim 9 wherein the fuel is comprised of about 45% to about 50% coal and about 50% to about 55% water.

11. The method of claim 9 wherein the water soluble lubricant is U CON 50HB5100.

12. A fuel injector for delivering a coal-water slurry fuel to an internal combustion engine comprising:

an injector tip having a central bore;

a nozzle operatively positioned at one end of the bore and having a pocket, an area and at least one high pressure duct for delivering the fuel to the engine;

a fuel intake port for delivering the fuel into the bore;

an adjustable needle valve operatively positioned in the bore, and defining a space there-between, the needle valve comprising a first cylindrical portion having a first diameter, and a second cylindrical portion having a second diameter which is smaller than the first diameter, the first cylindrical portion defining the space for passing replenishment water comprising about 70% water and about 30% water soluble lubricant into the area such that the replenishment water dilutes the residual fuel in the injector, purges dried coal particles, and reduces clogging in the injector.

13. The fuel injector of claim 12 wherein the coal water slurry fuel is composed of about 45% to about 50% coal and about 50% to about 55% water.

14. The fuel injector of claim 12 wherein the water soluble lubricant is U CON 50HB5100.

15. A fuel injection system for supplying a coal-water slurry fuel to an internal combustion engine, the system comprising:

a fuel injection nozzle;

a source of coal-water slurry operatively connected to the nozzle;

means for selectively providing the slurry to the nozzle;

replenishment water containing a water soluble lubricant;

means for providing the replenishment water to the nozzle; and means, operatively associated with the nozzle, the slurry providing means and the replenishment water providing means, for diluting the residual slurry water in the nozzle between operating cycles of the engine.

16. The system of claim 15 wherein the replenishment water comprises about 70% water and about 30% of the water soluble lubricant.

17. The system of claim 15 wherein the fuel is composed of about 45% to about 50% coal and about 50% to about 55% water.

18. The system of claim 15 wherein the water soluble lubricant is U CON 50HB5100.

* * * * *